US006089686A

United States Patent [19]

Thornton et al.

[11] Patent Number: 6,089,686

[45] Date of Patent: Jul. 18, 2000

[54] METHOD FOR SUPPLYING INK TO AN INK JET PRINTER

[75] Inventors: Gregory P. Thornton, Tigard; Donald B. MacLane, Portland; Gregory K. Justice, Tualatin, all of Oreg.

[73] Assignee: Xerox Corporation, Stamford, Conn.

[21] Appl. No.: 08/864,251

[22] Filed: May 28, 1997

[51] Int. Cl.[7] ..... B41J 2/195

[52] U.S. Cl. ..... 347/7

[58] Field of Search ..... 340/592, 593, 340/620; 347/5, 7, 6, 14, 17, 19, 23; 358/406; 399/29, 30, 57, 58, 61, 62, 63, 64, 233, 237, 238

[56] References Cited

U.S. PATENT DOCUMENTS

| | | | |
|---|---|---|---|
| 4,193,010 | 3/1980 | Kumpanek | 310/330 |
| 4,593,292 | 6/1986 | Lewis | 346/1.1 |
| 4,609,924 | 9/1986 | De Young | 346/1.1 |
| 4,636,814 | 1/1987 | Terasawa | 346/140 R |
| 4,742,364 | 5/1988 | Mikalsen | 346/140 |
| 4,870,430 | 9/1989 | Daggett et al. | 346/140 |
| 5,162,817 | 11/1992 | Tajika et al. | 346/140 R |
| 5,255,019 | 10/1993 | Mochizuki et al. | 346/140 |
| 5,315,317 | 5/1994 | Terasawa et al. | 346/1.1 |
| 5,329,304 | 7/1994 | Koizumi et al. | 347/7 |
| 5,386,224 | 1/1995 | Deur et al. | 347/7 |
| 5,442,387 | 8/1995 | Loofbourow et al. | 347/88 |
| 5,534,899 | 7/1996 | Uchikata et al. | 347/49 |
| 5,574,484 | 11/1996 | Cowger | 347/7 |
| 5,900,888 | 5/1999 | Kurosawa | 347/7 |

*Primary Examiner*—Arthur T. Grimley
*Assistant Examiner*—Hoang Ngo
*Attorney, Agent, or Firm*—Francis I. Gray; Ralph D'Alessandro

[57] ABSTRACT

An improved method for providing a continuous supply of liquid ink to an ink jet print head is provided. The method maintains an estimate in a memory source of the amount of liquid in a reservoir that is available to the print head. The estimate is periodically updated by information received from an ink sensor in the reservoir. By comparing the estimate to a plurality of ranges, the method determines whether additional ink may be added to the reservoir.

38 Claims, 12 Drawing Sheets

FIG. 5B
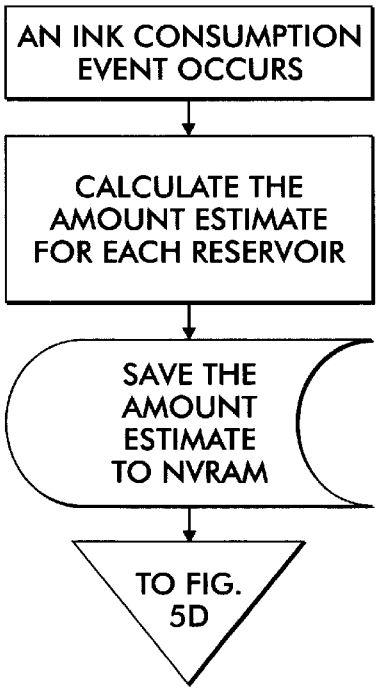
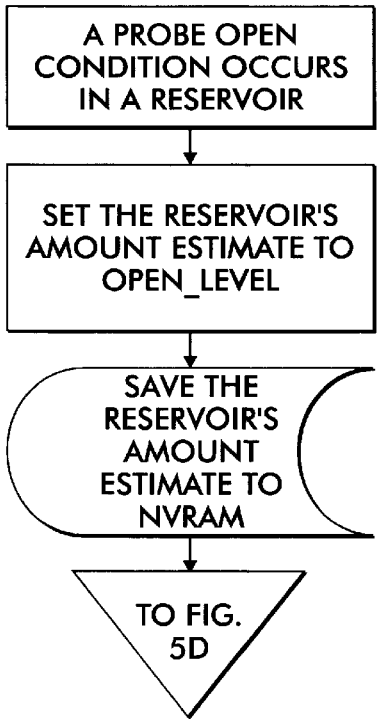
FIG. 5C

METHOD FOR SUPPLYING INK TO AN INK JET PRINTER

FIELD OF INVENTION

The present invention relates generally to an improved method for supplying ink to an ink jet printer. More specifically, this invention relates to an improved method for providing a continuous supply of liquid ink to an ink jet print head to maximize printing through-put by minimizing ink loading interventions.

BACKGROUND OF THE INVENTION

Certain types of ink jet printers typically create a printed image by ejecting liquid ink droplets through orifices positioned on an orifice plate in a print head. In general, each ink jet of a multiple-orifice drop-on-demand ink jet array print head operates by displacing ink in an ink pressure chamber and ejecting ink droplets from an associated orifice. A driver mechanism is used to displace the ink in the ink pressure chamber. The driver mechanism typically includes a transducer (e.g., a piezo-ceramic material) bonded to a thin diaphragm. When a voltage is applied to the transducer, it displaces ink in the ink pressure chamber, causing the ink to flow through an inlet from an ink manifold to the ink pressure chamber and through an outlet and passageway to the orifice. From the orifice, the ink is jetted onto an image receiving medium, such as a print medium or an intermediate transfer drum that transfers the image to the print medium.

Two inks commonly used in ink jet printers are aqueous ink and phase change or solid ink. Phase change ink has a liquid phase when it is above its melting temperature, for example 86° C., and a solid phase when it is at or below the melting temperature. Phase change ink is conveniently stored, transported and inserted into an ink jet printer assembly in solid phase. However, for phase change ink to be properly ejected from a print head, the ink must be in the liquid phase and relatively hot. Because it typically takes a few minutes for phase change ink to melt after heat has been applied to it, there must be a continuous supply of melted ink having the proper temperature for the print head to eject.

The chemistry of phase change inks poses challenges to providing a continual supply of phase change ink in the liquid state. It is generally undesirable to heat a large supply of phase change ink or to maintain phase change ink in a liquid state for extended periods of time because this results in "cooking" or degrading the ink. Therefore, heating of phase change inks must be carefully regulated to avoid such heat degradation, while simultaneously maintaining a sufficient supply of liquid ink to minimize delays and/or interruptions in printer operations to load ink.

Some ink jet printers utilize a print head that translates or shuttles bi-directionally relative to a transfer drum or a final receiving medium. Many of these printers also incorporate a stationary ink supply assembly that requires the print head to be positioned adjacent to the supply assembly for delivery of ink to the print head. In order to minimize printing interruptions for ink loading, these systems must have a relatively large amount of liquid ink available to the print head at all times. In the case of phase change ink, this requires the ink to be kept in a molten state at an elevated temperature for extended periods of time, thereby creating the possibility of ink degradation.

It is known in the prior art to utilize a reservoir for maintaining a supply of liquid ink and a detector for determining whether the ink in the reservoir is below a particular level. Typically, the ink level detector indicates a low ink condition to the operator and/or triggers an automatic ink loading procedure only when the ink level drops below a critical fixed amount. This can result in interruptions and delays in printer operations for ink loading, as well as a large amount of ink remaining in the molten state for extended periods of time.

To overcome the drawbacks of the prior art systems, an improved method for providing a continuous supply of liquid ink to an ink jet print head is provided. The method coordinates the supply of liquid ink with other printer operations to minimize ink loading interventions. The method also ensures that the print head is consistently supplied with an adequate amount of molten ink to minimize interruptions and/or delays for ink loading. This is accomplished by maintaining a continuously updated amount estimate for each reservoir in a memory source and comparing the estimate to a plurality of ranges to determine if a reservoir should receive additional ink.

SUMMARY OF THE INVENTION

It is an aspect of the present invention to provide an improved method for providing a continuous supply of ink to an ink jet print head in an imaging apparatus.

It is another aspect of the present invention to provide an improved ink supply method that is coordinated with the other operations of the imaging apparatus.

It is a feature of the method of the present invention that estimation techniques are utilized to generate an estimate of the amount of ink available to the print head.

It is another feature of the method of the present invention that the estimation techniques overestimate the amount of ink available to the print head to avoid overfilling while also ensuring that an adequate amount of ink is continuously available to the print head.

It is another feature of the method of the present invention that the estimate of the amount of ink available to the print head is maintained in a memory source and is periodically updated upon the execution of particular events.

It is yet another feature of the method of the present invention that the method defines a plurality of ranges of amounts that are utilized to determine when ink loading must occur and when ink loading may occur with minimal impact on other operations of the imaging apparatus.

It is an advantage of the method of the present invention that the method has a minimal impact on printing throughput.

It is another advantage of the method of the present invention that the method insures that the print head always has a sufficient supply of ink to complete an ink consumption operation, such as printing.

To achieve the foregoing and other aspects, features and advantages, and in accordance with the purposes of the present invention as described herein, an improved method for providing a continuous supply of liquid ink to an ink jet print head is provided. The method maintains an estimate in a memory source of an amount of liquid ink in a reservoir that is available to the print head. The estimate is periodically updated by actual amount information received from an ink sensor in the reservoir. By comparing the estimate to a plurality of ranges, the method determines whether additional liquid ink should be made available to the print head. The method insures that a sufficient supply of liquid ink is always available for the print head, while also minimizing, interruptions and delays in printer operations due to ink loading interventions.

Still other aspects of the present invention will become apparent to those skilled in this art from the following description wherein there is shown and described a prefer red embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE DRAWINGS

FIGS. 5*a–h* show detailed flow diagrams illustrating a preferred embodiment of the method of the present invention for providing a continuous supply of liquid ink to an ink jet print head.

Reference will now be made in detail to the present preferred embodiment of the invention, an example of which is illustrated in the accompanying drawings.

DETAILED DESCRIPTION OF THE PREFERRED EMBODIMENT

Figure 1:
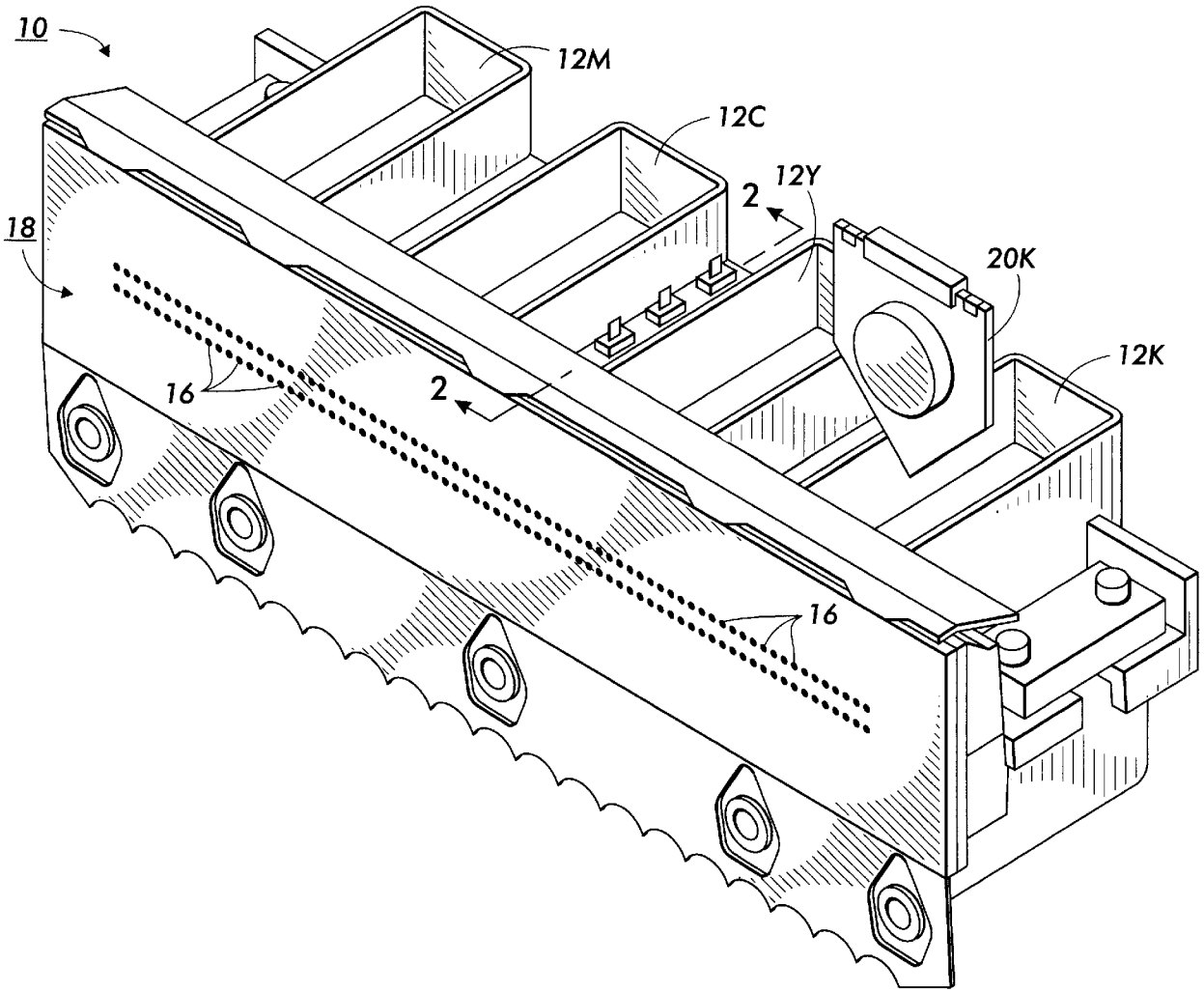
FIG. 1 is a perspective view of a print head assembly with which the method of the present invention may be utilized, the print head assembly including a plurality of orifices extending across an orifice plate and four ink receiving buckets corresponding to four different colors of ink.

FIG. 1 is an illustration of an ink jet print head, generally indicated by the reference numeral 10, that may be utilized in an ink jet printer that incorporates the method of the present invention. The print head 10 includes four buckets 12M, 12C, 12Y and 12K for receiving liquid ink of four different colors (for example, cyan, magenta, yellow and black). The ink drips into the buckets 12 from melt plates 20, only one of which (20 k) is shown. The melt plates 20 are a component of the ink supply assembly of the printer (not shown), as described below. An example of a print head similar to the print head 10 illustrated in FIG. 1 is found in the Tektronix Phaser® 350 solid ink color printer.

In the Phaser® 350 color printer, solid ink sticks of the four different colors are utilized with a shape-discriminating ink stick loading system that permits only the correctly colored ink stick to be inserted into a feed chute corresponding to that color. Each of the individual feed chutes guides the ink sticks to a heated melt plate located above the corresponding bucket in the print head, whereupon the ink stick is melted and the molten ink drips into the bucket. A more detailed disclosure of the ink supply assembly and melt plate design of the Phaser® 350 printer is found in the copending U.S. patent Ser. No. 08/612,149 entitled INK SUPPLY ASSEMBLY (the '903 patent) and U.S. Pat. No. 5,784,809 entitled IMPROVED MELT PLATE DESIGN FOR A SOLID INK PRINTER (the '089 patent), both applications being assigned to the assignee of the present application. The '903 and '089 patents are hereby specifically incorporated by reference in pertinent part.

The following description of a preferred embodiment of the ink supply method of the present invention refers to its use with a solid ink color printer having an ink supply assembly and melt plates of the type described in the '903 and '089 patents. It will be appreciated, however, that the present ink supply method may be used with various other imaging and printing apparatus that utilize different imaging technologies and/or architectures and require a continuing supply of liquid ink, such as an aqueous ink jet printer. Accordingly, the following description will be regarded as merely illustrative of one embodiment of the present invention.

The ink stick loading and melting system described in the '903 and '089 patents and found in the Phaser® 350 printer is stationary relative to the printer frame and the print head. The print head translates across a rotating intermediate transfer drum as liquid ink pixels or droplets are jetted onto an intermediate transfer surface on the drum. A final receiving medium is then brought into contact with the drum to transfer the ink image to the medium.

The Phaser® 350 printer prints on A4-size (21.0 cm×29.7 cm) and smaller media, and the print head in this printer is substantially a wide as the widest media printed. It follows that the print head need only translate a small distance, approximately 9.7 mm, across the transfer drum to create the ink image on the drum. Thus, the print head buckets are always positioned below their corresponding melt plate to receive liquid ink. This allows liquid ink to be delivered to the print head at any time, even during a printing operation, without interrupting the operation in progress.

To print on wider media such as B-size (27.9 cm×42.0 cm) media, a print head such as the Phaser® 350 print head is required to translate a greater distance across the transfer drum to produce the image. Thus, the buckets in the print head will not always be in position to receive ink from their corresponding melt plates. Loading of liquid ink from the melt plates into the print head buckets must therefore be coordinated with the other operations of the printer to insure that the print head is properly positioned to receive the ink. Also, the timing of an ink loading procedure should be selected to minimize any interference with or delay to the other printer operations. This is one example of a printing application to which the method of the present invention is addressed.

Returning to FIG. 1, the melt plate 20K is shown above the bucket 12K. It will be appreciated that three other melt plates (not shown) are positioned above the other three buckets 12M, 12C and 12Y when the print head is positioned to receive ink. The following description of melt plate 20K applies equally to the other three melt plates and buckets. In the preferred embodiment, the melt plate 20K produces liquid ink at a rate between 5.7 grams/minute and 7.4 grams/minute during steady state melting. In reaching steady state melting from a cold start, the melt plate 20K melts between 0.51 grams and 2.89 grams of ink. The time to reach steady state melting from a cold start, or the transition start period, is approximately 50 seconds. The time required to stop the melting of ink by the melt plate 20K, or the transition stop period, is between 37 and 57 seconds. The amount of ink melted during the transition stop period is between 1.10 grams and 1.70 grams.

Figure 2:
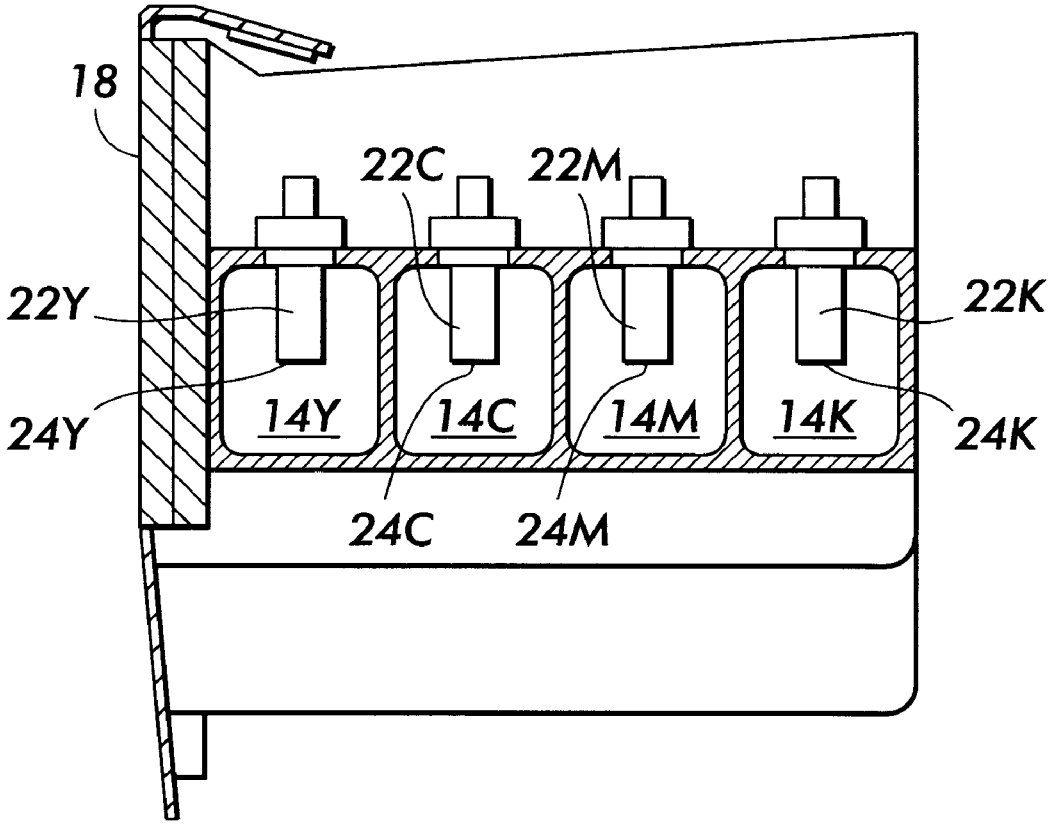
FIG. 2 is a side sectional view taken along lines 2—2 of FIG. 1 showing four reservoirs corresponding to the four different colors of ink, each of the reservoirs having a probe extending into the reservoir.

Referring now to FIGS. 1 and 2, ink dripping into each bucket 12M, 12C, 12Y and 12K is directed into a corresponding reservoir 14M, 14C, 14Y or 14K. From each of the reservoirs 14, the ink is communicated to a plurality of orifices 16 located on an orifice plate 18 for jetting. Repeated printing builds up contaminants, such as unused ink and debris from the print medium, in the orifices 16 and on the orifice plate 18. To ensure uniform jetting and a high quality printed image, the print head 10 must be periodically cleaned of this contamination to provide an unobstructed ink trajectory from the orifices. A typical conventional cleaning sequence entails purging or drawing ink and debris from the orifices onto the orifice plate and then wiping the contamination from the orifice plate.

Depending upon the operating status of the print head, several types of purging operations are utilized. A cold purge is a purging operation performed on a "cold" print head that is not at operating temperature, such as when a printer is powered up after an extended down period. A hot purge is a purging operation performed on a print head that is at operating temperature. A third type of purging operation is a high voltage purge. This refers to purging the print head while firing the piezo-electric transducers at a higher voltage than is used for standard printing. Each of these purging operations uses a different amount of ink. In the preferred embodiment, the amount of ink used in a cold purge is approximately 5.8 grams, the amount of ink used in a hot purge is approximately 3.4 grams, and the amount of ink used in a high voltage purge is approximately 4.7 grams.

With reference now to FIG. 2, in the preferred embodiment of each reservoir 14 has a capacity of 24.25 grams of ink. Each reservoir 14 also utilizes a sensor for detecting an amount of ink in the reservoir. Preferably, the sensor comprises a stainless steel conductivity probe 22 that extends downwardly into the reservoir 14. As described in conjunction with the method of the present invention, the distal portion 24 of each probe 22 is positioned at the 12.5 gram level in each reservoir 14, and each probe 22 has a position tolerance of ±1.75 grams.

Figure 3A:
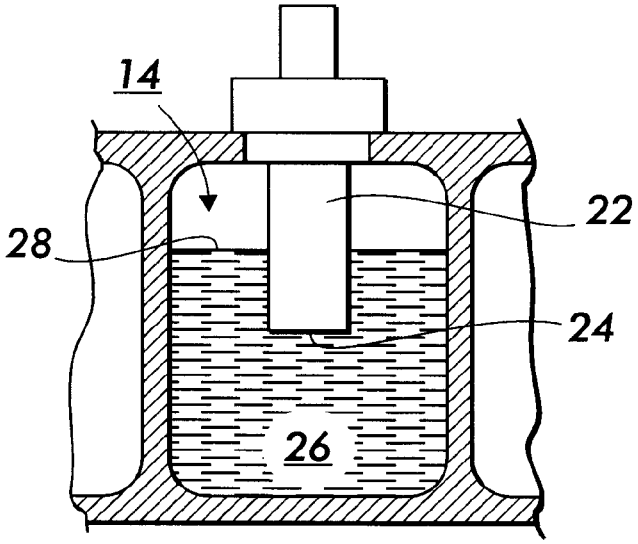
FIG. 3*a* is an enlarged side sectional view of one of the reservoirs showing the probe extending below the surface of the ink.
Figure 3B:
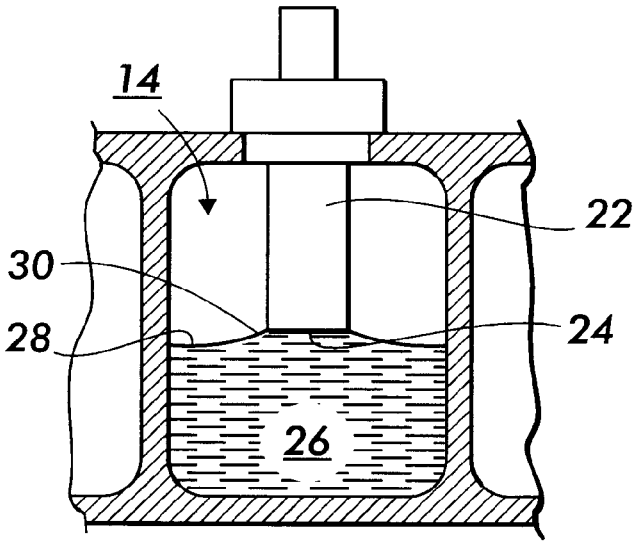
FIG. 3*b* is an enlarged side sectional view of one of the reservoirs showing a meniscus keeping the ink in contact with the bottom of the probe.

Each of the probes 22Y, 22C, 22M and 22K forms a portion of an electrical circuit (not shown). If ink is in contact with a probe 22, the circuit corresponding to that reservoir provides a low voltage signal corresponding to a probe closed condition. If ink is not in contact with a probe 22, the circuit provides a high voltage signal corresponding to a probe open condition. FIGS. 3*a*–3*d* illustrate varying amounts of ink 26 within a representative reservoir 14 and the relation between the upper surface 28 of the ink 26 and the distal portion 24 of the probe 22. In FIG. 3*a*, the upper surface 28 of the ink 26 is well above the distal portion 24 of the probe 22, and the circuit signal is interpreted as the probe closed condition. During an ink consumption operation, such as printing or purging, the amount of ink in a reservoir will be reduced. With reference to FIG. 3*b*, as the upper surface 28 of the ink 26 falls to just below the distal portion 24 of the probe 22, the ink forms a meniscus 30 that maintains contact with the distal portion 24. At the moment the meniscus 30 is broken, the electrical circuit provides a signal interpreted as the probe open condition and the ink level is approximately 2.5 grams below the position of the probe distal portion 24. At this moment, the ink amount in the reservoir is defined as 8.25 grams, calculated as 12.5 grams (probe position)−2.5 grams (meniscus)−1.75 grams (probe tolerance)=8.25 grams.

Figure 3C:
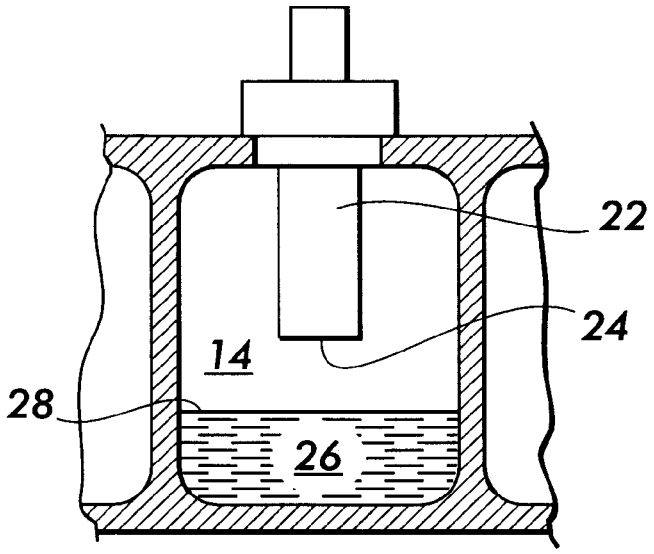
FIG. 3*c* is an enlarged side sectional view of one of the reservoirs showing the surface of the ink below and not in contact with the bottom of the probe.
Figure 3D:
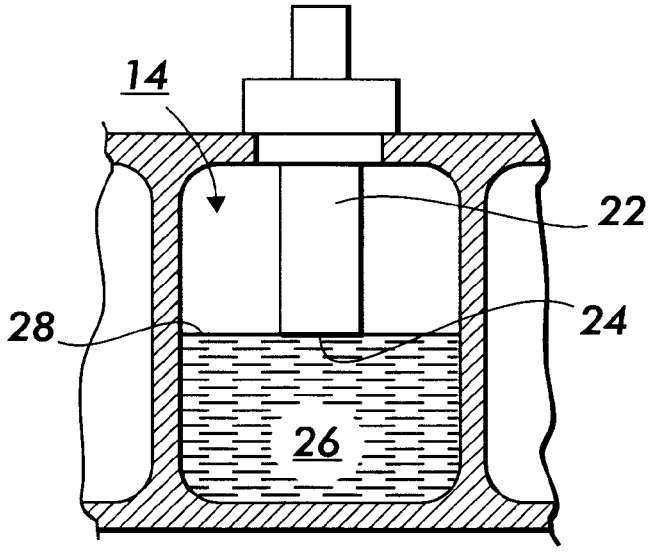
FIG. 3*d* is an enlarged side sectional view of one of the reservoirs showing the surface of the ink being level with the bottom of the probe.

As shown in FIG. 3*c*, the ink 26 in the reservoir 14 may continue to be used after the probe open condition occurs, with the upper ink surface 28 falling well below the probe distal portion 24. If ink is then added to the reservoir 14, the upper ink surface 28 will rise toward the probe distal portion 24. With reference now to FIG. 3*d*, at the moment the upper ink surface 28 contacts the probe distal portion 24, the electrical circuit enters the probe closed condition. The ink level at this point is defined as 10.75 grams, calculated as 12.5 grams (probe position)−1.75 grams (probe tolerance)=10.75 grams.

Figure 4:
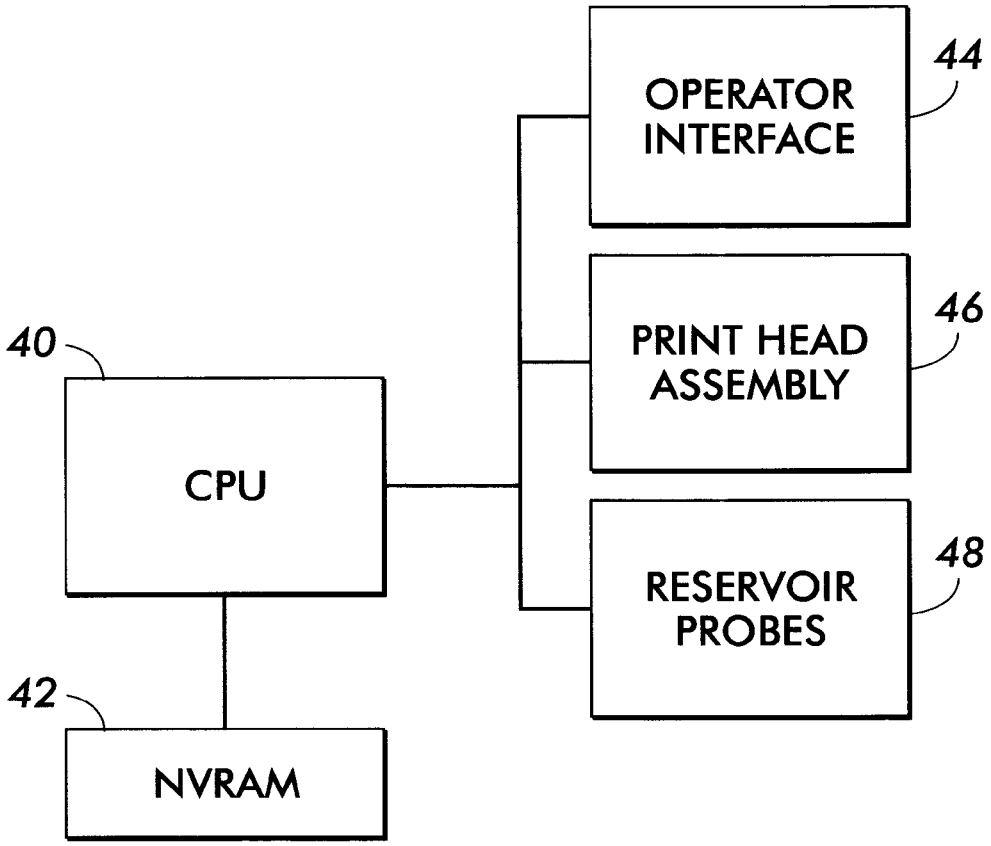
FIG. 4 is a simplified schematic diagram of a processing unit and a memory source in an ink jet printer that utilizes the method of the present invention, the processing unit being in communication with an operator interface module, a print head assembly and the probes in the reservoirs.

With reference now to FIG. 4, the method of the present invention is preferably implemented by a processor or CPU 40 within the printer. As described in more detail below, the CPU 40 communicates with a memory source that stores an estimate of an amount of ink in each reservoir. In the preferred embodiment, the memory source comprises a non-volatile RAM, or NVRAM 42. The CPU 40 also sends printer states information to an operator interface 44 and receives operational commands from the interface, such as an operator-requested purging operation. Information from the print head assembly 46 and the reservoir probes 48 is also communicated to the CPU 40 and is utilized by the present method as explained below.

With reference now to FIGS. 5*a*–5*h*, the method of the present invention will now be described in conjunction with the preferred ink supply assembly and print head that is described above. It is again emphasized that the present method may be utilized with other imaging apparatus and technologies that differ from the preferred embodiment now presented. For example, while the present method is described in conjunction with ink reservoirs that are integral with the print head, the present method may also be practiced with printing apparatus having ink reservoirs that are not integral with the print head. Accordingly, the description of the preferred embodiment of the present method will not be interpreted as limiting the applicability of the method to the particular apparatus disclosed.

Figure 5A:
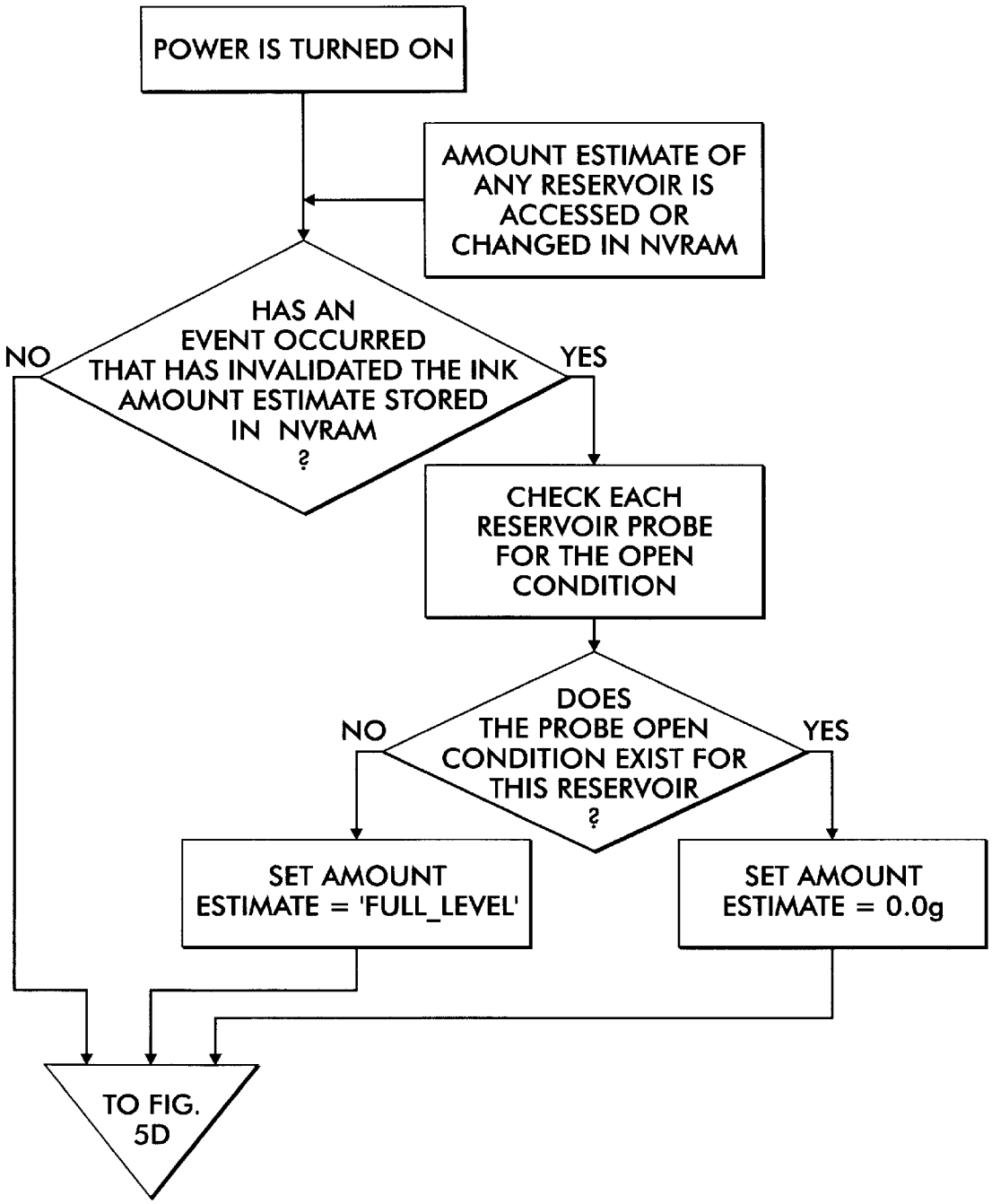

As mentioned above, and in an important aspect of the present invention, an estimate of an amount of liquid ink in each reservoir is maintained in an NVRAM. By utilizing NVRAM to store the estimates, the estimates are maintained even when power to the printer is cycled or unintentionally disconnected. With reference now to FIG. 5*a*, whenever the power to the printer is cycled, or whenever a reservoir amount estimate is accessed or changed, the method of the present invention determines whether an event has occurred that has invalidated the ink amount estimates stored in NVRAM. The following are examples of events that invalidate the ink amount estimates: an uninitialized NVRAM is detected; a new NVRAM format or value version is detected; the print head has been replaced; a printer service mode is selected; an asynchronous power loss during an ink load cycle or ink consumption sequence is detected; and a purging operation is terminated prior to completion.

If the ink amount estimates have not been invalidated, then the method proceeds to determine whether additional liquid ink is required in each reservoir or may be added without interrupting printer operations, as described in more detail below with reference to FIG. 5*d*.

With continued reference to FIG. 5*a*, if the amount estimates have been invalidated, the probe in each reservoir is then checked to see if the corresponding electrical circuit is open (probe open condition) or closed (probe closed condition). If a reservoir has a probe open condition, the reservoir is assumed to be empty and the amount estimate for that reservoir is set to 0.0 grams in NVRAM. If the reservoir has a probe closed condition, the amount estimate for that reservoir is set to 15.0 grams. After the new amount estimates are set in NVRAM, the method continues with the steps outlined in FIG. 5*d*.

With reference now to FIG. 5*b*, whenever an ink consumption event occurs, such as a printing or a purging operation, the method of the present invention calculates an estimate of the amount of ink remaining in each reservoir after the ink consumption operation. In the preferred embodiment, ASICS count the number of jets fired for each color of ink, and thus the number of ink pixels jetted, during a printing operation to estimate the amount of each color of ink that is utilized. This amount is then subtracted from the estimate in NVRAM for the corresponding reservoir to determine the amount of ink remaining in the reservoir after the printing operation. The updated estimate is saved in NVRAM as the new estimate of the amount of ink remaining in the reservoir after the printing operation. In an alternative embodiment, the image bit map generated by the page description language is analyzed to calculate the amount of each color of ink that is necessary to print a selected image. The calculated amount for each color is subtracted from the estimate in NVRAM for that reservoir to determine the amount of ink remaining in the reservoir after the printing operation.

If a purging operation is performed, a predetermined amount of ink is subtracted from the estimate in NVRAM for each reservoir to yield the amount of ink in the reservoir after the purging operation. For a cold purge, the predetermined amount is 5.8 grams, for a hot purge the amount is 3.4 grams and for a high voltage purge the amount is 4.7 grams.

After an ink consumption event is completed and the amount estimates in NVRAM have been updated, the method proceeds to compare the updated amount estimates with a plurality of ranges of amounts, as further described below with reference to FIG. 5*d*.

With reference now to FIG. 5*c*, the probe in a reservoir will enter the probe open condition during an ink composition event if the ink in the reservoir loses contact with the probe. When this occurs, the amount estimate for that reservoir in NVRAM is updated to open_level, which is preferably 8.25 grams. Advantageously, by updating the estimates in NVRAM with amount information obtained from the probes in this manner, the estimates are continuously correlated with actual reservoir amounts as measured by the probes. After updating the amount estimate for the reservoir having the open probe condition, the method then proceeds with the steps of FIG. 5*d* as will now be described.

Figure 5D:
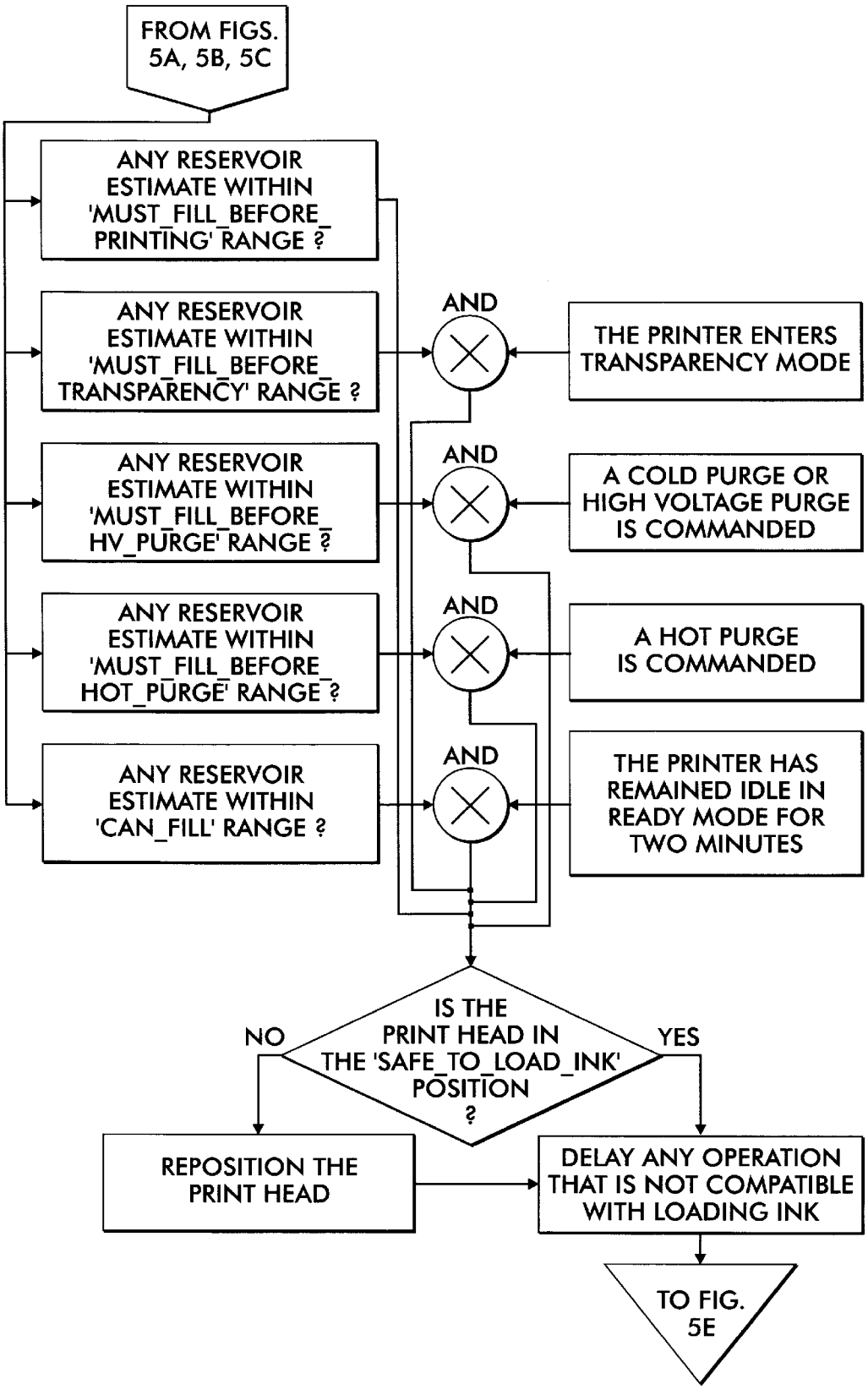

FIG. 5*d* illustrates the steps utilized by a preferred embodiment of the present invention to determine whether to initialize an ink loading procedure. Whenever a reservoir ink amount estimate in NVRAM is accessed or updated, each amount estimate is compared to a plurality of ranges to determine which range, if any, encompasses the estimate. Based on the range encompassing the estimate and the status of the printer, the method determines whether to add additional ink to a reservoir. As described below, in an important aspect of the present invention the ranges and other variables are defined in relation to different printer operations, such as printing and purging, to ensure that the ink loading processes have a minimal impact on printing through-put.

As shown in FIG. 5*d*, the reservoir estimates and the printer are examined for the following conditions: any estimate within the must_fill_before_printing range; any estimate within the must_fill_before_transparency range AND the printer enters transparence mode; any estimate within the must_fill_before hv_purge range AND a cold purge or high voltage purge is commanded; any estimate within the must_fill_before_hot_purge range AND a hot purge is commanded; and any estimate in the $can_{13}$fill range AND the printer has remained idle in a READY mode for two minutes. The preferred values for these ranges are as follows:

must_fill_before_printing=4.10 grams or less; must_fill_before_transparency=5.60 grams or less; must_fill_before_hv_purge=6.00 grams or less;

must_fill_before_hot_purge=3.50 grams or less; and can_fill=11.50 grams or less.

If any of the above conditions exist, the method proceeds to determine if the print head is in the safe_to_load_ink position. This position corresponds to the print head being located under the ink supply assembly such that ink from each melt plate will drip into the proper bucket. If the print head is not in the safe_to_load_ink position, the print head is relocated to this position. The method then delays any operation that is not compatible with loading ink and determines for each reservoir whether an open probe condition exists (see FIG. 5*e*, block 50). If an open probe condition does not exist for a reservoir the method then determines (1) whether the amount estimate for that reservoir is within the can_fill range (11.50 grams or less) and (2) whether an amount less than a loading_limit amount of ink has been added to the reservoir since the last probe open condition for that reservoir (see FIG. 5*f*, block 52). If the answer to either of queries (1) or (2) is NO, then no ink is added to the reservoir. Query (2) is utilized to ensure that the amount estimate for a reservoir is updated by a probe open condition at least as often as the loading_limit amount of ink is added to the reservoir. In this manner, the method protects against overfilling and possibly overflowing the reservoir by periodically correlating the amount estimate for the reservoir to the actual amount of ink in the reservoir as determined by the probe, regardless of the value of the amount estimate present in NVRAM. Thus, whenever the loading_limit, preferably 40 grams, of ink is added to a reservoir without an intervening probe open condition, the method disables ink loading to that reservoir until a probe open condition occurs.

Returning to FIG. 5*f*, block 52, if the answer to both queries (1) and (2) is YES, the method calculates a melt_time defined as the time required to melt and add an amount of ink to the reservoir to fill the reservoir to a fill_level. Preferably, the melt_time=[(full_level−amount estimate−starting_transient_mass−stopping_transient_mass)/melt_rate]+start_time. The preferred values for the above factors are as follows: full_level=15.0 grams; starting_transient_mass=2.10 grams; stopping_transient_mass=1.50 grams; melt_rate=0.117 grams/second; and start_time=50 seconds.

The preferred melt_rate value utilized by the present method is slightly higher than the actual melt rate of the ink loading system. In this manner, the actual amount of ink added to the reservoir will fill the reservoir to less than the full_level. In the course of repeated fillings based on the reservoir having a closed probe condition and being in the can_fill range, the actual amount of ink in the reservoir after a fill process will gradually fall until a probe open condition occurs. Advantageously, this ensures that a probe open condition occurs with some regularity to update the amount estimate for that reservoir with an actual amount as measured by the probe open condition.

Once the melt_time is calculated, a timer is started and the ink melt plate corresponding to that reservoir is activated in the ink supply assembly to begin melting ink. When the timer=melt_time, the melt plate is deactivated and printer operations are delayed until an additional drip_time has elapsed. The preferred value of drip_time=65 seconds. Once the drip_time has elapsed, the method waits for any ink loading in the other three reservoirs to be completed, at which time the printer is returned to a READY status.

Figure 5E:
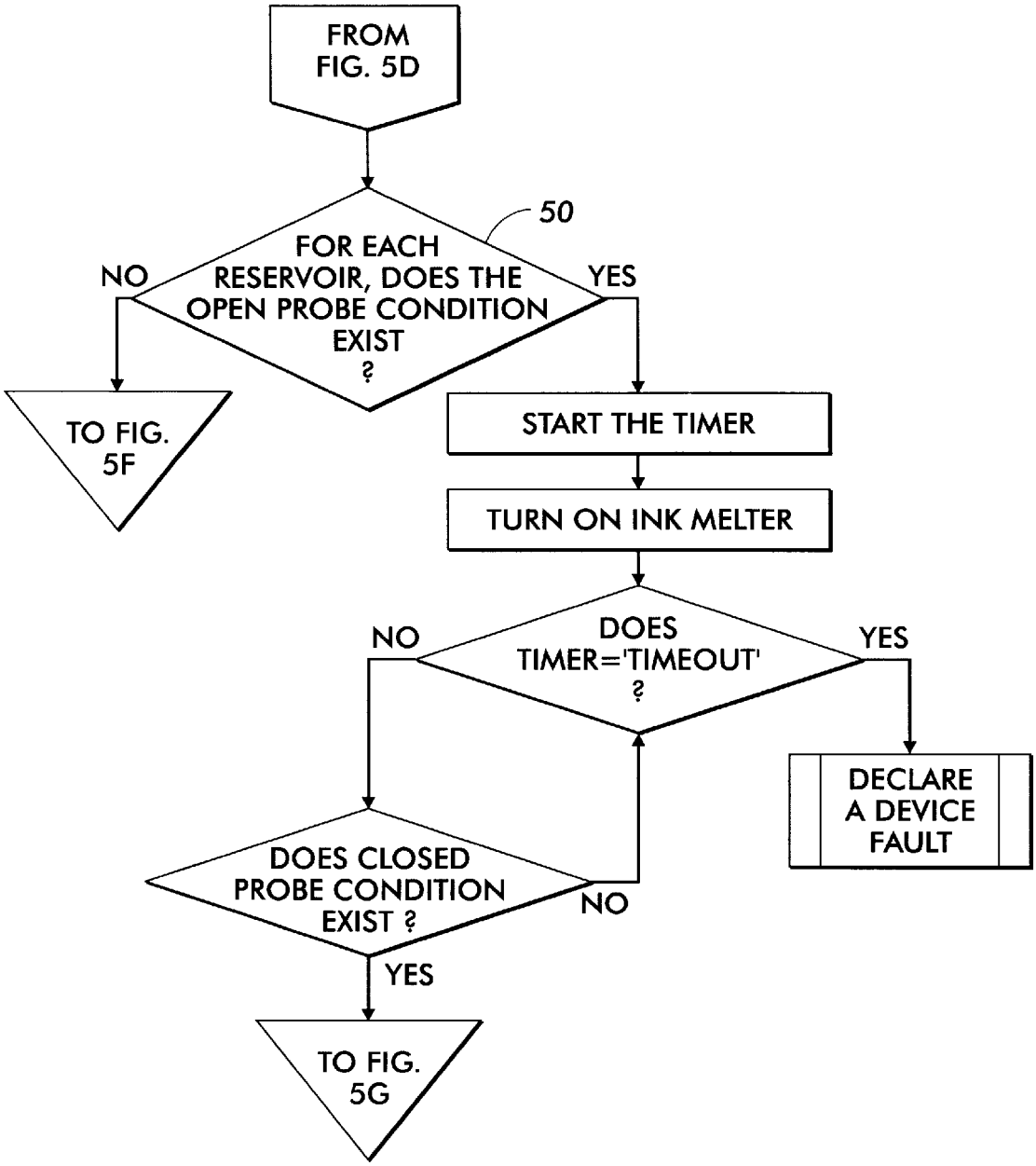
Figure 5F:
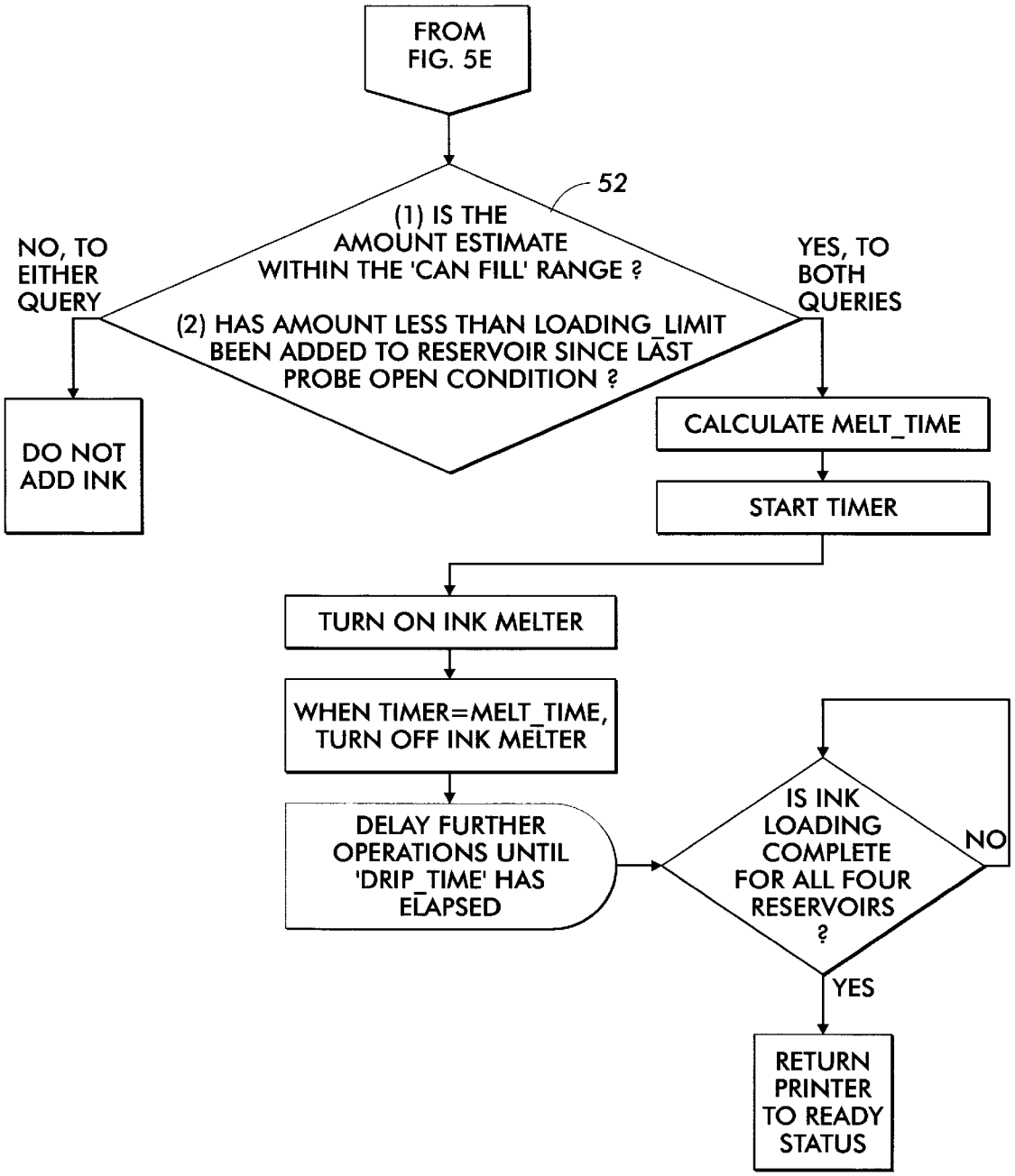

Returning to block 50 in FIG. 5*e,* if an open probe condition does exist in a reservoir, the timer is started and the melt plate corresponding to that reservoir is activated. As ink is added to the reservoir, the timer is monitored for a "timeout" condition and the probe in that reservoir is monitored for the probe closed condition. If the timer="timeout", which is preferably defined as 500 seconds, before the reservoir probe closes the associated electrical circuit, the method assumes a malfunction has occurred, declares a device fault and deactivates the melt plate. If the reservoir probe closes before the timer="timeout", the method continues as illustrated in FIG. 5*g*.

Figure 5G:
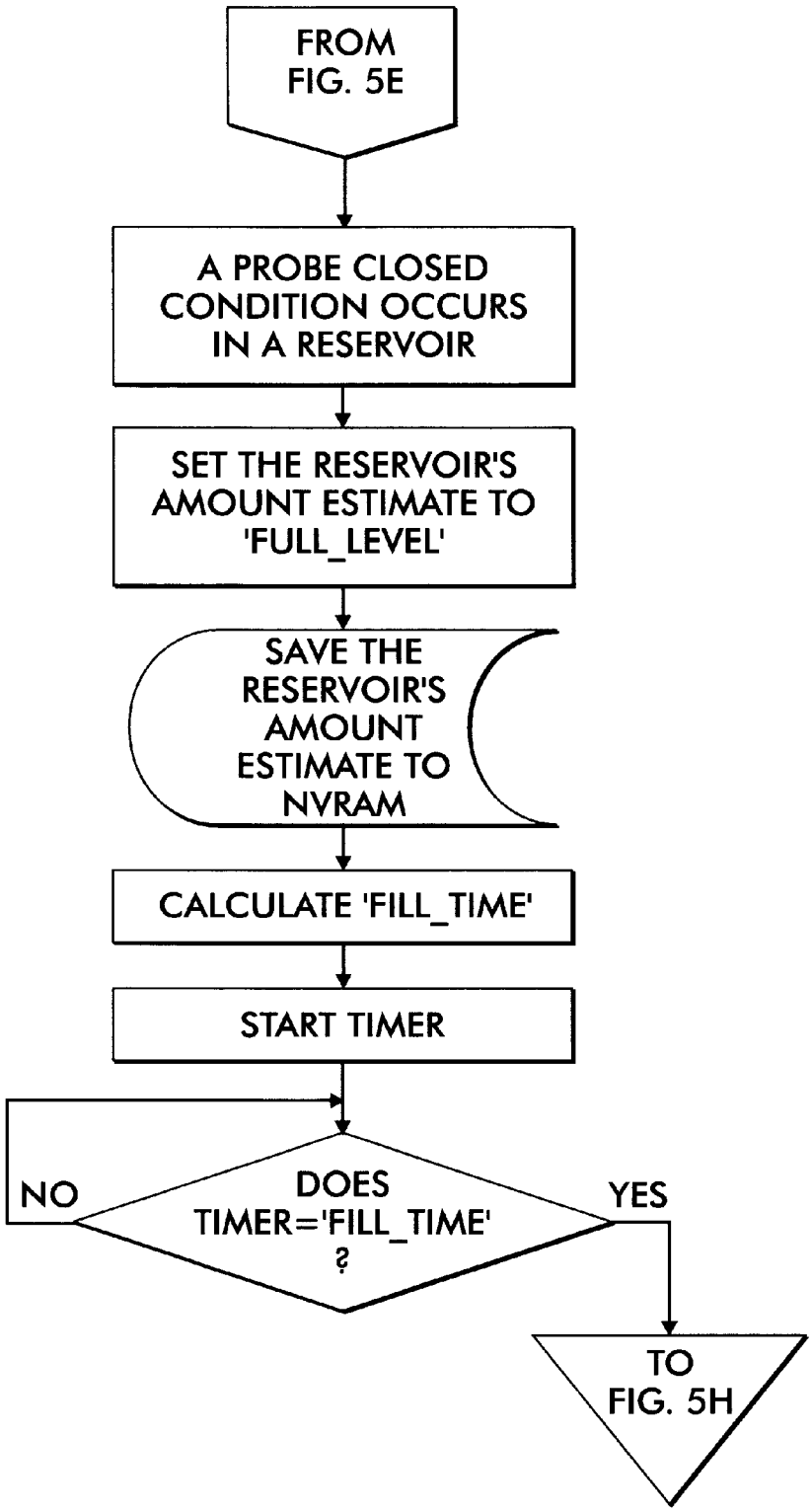
Figure 5H:
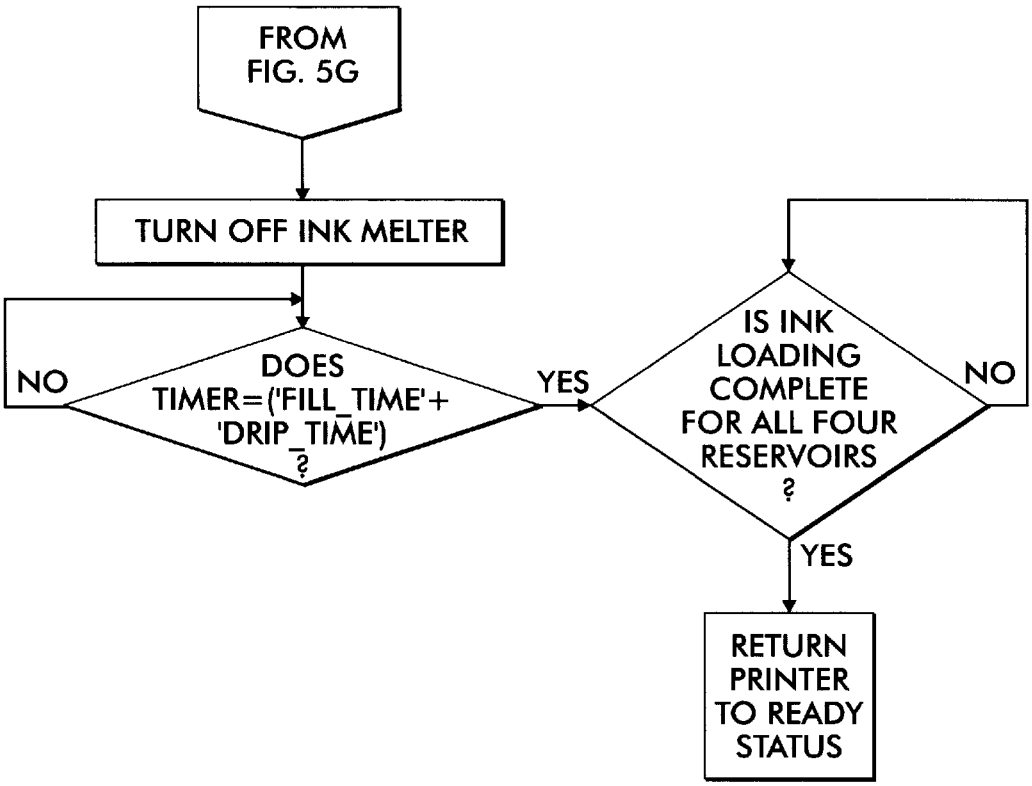

As shown in FIG. 5*g,* when a probe closes the amount estimate for that reservoir is updated to a fill_level, preferably defined as 15.0 grams, and this amount estimate is saved in NVRAM. A fill_time is calculated and a timer is then started. Preferably, the fill_time=(full_level−closed_level−stopping_transient_mass)/melt_rate, with closed_level=10.75 grams. When the timer=fill_time, the melt plate is deactivated and printer operations are delayed for an additional drip_time (see FIG. 5*h*). Once the drip_time has elapsed, the method waits for any ink loading in the other three reservoirs to be completed, at which time the printer is returned to a READY status.

In summary, the present invention utilizes a continuously-maintained amount estimate for each reservoir to determine whether additional ink may be added to the reservoir. The amount estimates are periodically updated with actual amount information based on the status of a probe within the reservoir. In this manner, the amount estimates are periodically correlated with actual amounts that are physically measured in the: reservoir to minimize any error accumulation in the estimation techniques.

While the invention has been described above with reference to specific embodiments thereof, it is apparent that many changes, modifications and variations in the arrangements of steps and the apparatus that may utilize the present method can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A method for providing liquid ink to ink ejecting orifices in an ink jet print head in an imaging apparatus, the imaging apparatus including at least one reservoir for supplying the liquid ink to the orifices and a sensor for detecting an amount of ink in the reservoir, the method comprising the steps of:

a. maintaining an estimate in a memory source of an amount of liquid ink in the reservoir;

b. comparing the estimate of the amount of ink in the reservoir to a plurality of ranges of amounts to determine which of the ranges encompasses the estimate;

c. determining a status of the sensor; and d. adding ink to the reservoir if the status of the sensor and the range encompassing the estimate indicate that the reservoir may receive additional ink or the reservoir requires ink to be added before the imaging apparatus executes an operation.

2. The method for providing liquid ink to an ink jet print head according to claim 1, wherein the sensor comprises a conductivity probe that forms a portion of an electrical circuit, the electrical circuit providing a low voltage signal corresponding to a probe closed condition when ink contacts the probe and a high voltage signal corresponding to a probe open condition when ink is not in contact with the probe.

3. The method for providing liquid ink to an ink jet print head according to claim 2, wherein the probe closed condition occurs when the amount of ink in the reservoir is approximately 10.75 grams or more.

4. The method for providing liquid ink to an ink jet print head according to claim 3, wherein step d further comprises the steps of:

resetting the estimate stored in the memory source of the amount of ink in the reservoir to a different value when the probe closed condition occurs;

starting a timer when the probe closed condition occurs;

calculating a fill_time defined as a time required to add a predetermined amount of ink to the reservoir; and stopping a flow of ink to the reservoir when the timer=the fill_time.

5. The method for providing liquid ink to an ink jet print head according to claim 2, further including the step of resetting the estimate stored in the memory source of the amount of ink in the reservoir to a different value when the probe open condition occurs.

6. The method for providing liquid ink to an ink jet print head according to claim 5, wherein the probe open condition occurs when the amount of ink in the reservoir is approximately 8.25 grams or less.

7. The method for providing liquid ink to an ink jet print head according to claim 2, further including the step of determining whether an event has occurred that has invalidated the estimate in the memory source of the amount of ink in the reservoir.

8. The method for providing liquid ink to an ink jet print head according to claim 7, wherein if the estimate in the memory source has been invalidated and if the probe open condition is present, the method of claim 7 further includes the step of resetting the estimate to 0.00 grams.

9. The method for providing liquid ink to an ink jet print head according to claim 7, wherein if the estimate in the memory source has been invalidated and if the probe closed condition is present, the method of claim 7 further includes the steps of resetting the estimate to approximately 15.00 grams.

10. The method for providing liquid ink to an ink jet print head according to claim 9, wherein the reservoir has a capacity of at least approximately 20 grams.

11. The method for providing liquid ink to an ink jet print head according to claim 2, wherein the imaging apparatus includes at least four reservoirs corresponding to at least four different colors of ink.

12. The method for providing liquid ink to an ink jet print head according to claim 11, wherein the reservoirs are located within the print head.

13. The method for providing liquid ink to an ink jet print head according to claim 12, wherein the imaging apparatus comprises a solid ink printer.

14. The method for providing liquid ink to an ink jet print head according to claim 13, wherein the memory source comprises nonvolatile RAM.

15. A method for providing liquid ink to ink ejecting orifices in an ink jet print head in an imaging apparatus, the imaging apparatus including at least one reservoir for supplying the liquid ink to the print head orifices, the method comprising the steps of:

a. maintaining an estimate in a memory source of an amount of liquid ink in the reservoir;

b. comparing the estimate of the amount of ink in the reservoir to a plurality of ranges of amounts to determine which of the ranges encompasses the estimate;

c. determining if the print head is positioned to receive ink in the reservoir;

d. determining if the amount of ink in the reservoir is at or below a predetermined level; and e. adding ink to the reservoir.

16. The method for providing liquid ink to an ink jet print head according to claim 15, wherein steps c, d and e are performed if the estimate falls within a first range designated must_fill_before_hot_purge and the imaging apparatus receives a command to execute a hot purge operation.

17. The method for providing liquid ink to an ink jet print head according to claim 16, wherein the first range is defined as approximately 3.50 grams of ink or less.

18. The method for providing liquid ink to an ink jet print head according to claim 17, wherein steps c, d and e are performed if the estimate falls within a second range designated must_fill_before_printing.

19. The method for providing liquid ink to an ink jet print head according to claim 18, wherein the second range is defined as approximately 4.10 grams of ink or less.

20. The method for providing liquid ink to an ink jet print head according to claim 19, wherein steps c, d and e are performed if the estimate falls within a third range designated must_fill_before_transparency and the imaging apparatus receives a command to print a transparency.

21. The method for providing liquid ink to an ink jet print head according to claim 20, wherein the third range is defined as approximately 5.60 grams of ink or less.

22. The method for providing liquid ink to an ink jet print head according to claim 21, wherein steps c, d and e are performed if the estimate falls within a fourth range designated must_fill_before_high_voltage_purge and the imaging apparatus receives a command to execute a high voltage purge operation.

23. The method for providing liquid ink to an ink jet print head according to claim 22, wherein the fourth range is defined as approximately 6.00 grams of ink or less.

24. The method for providing liquid ink to an ink jet print head according to claim 23, wherein steps c, d and e are performed if the estimate falls within a fifth range designated can_fill and the imaging apparatus remains idle for a predetermined length of time.

25. The method for providing liquid ink to an ink jet print head according to claim 24, wherein the fifth range is defined as approximately 11.50 grams of ink or less.

26. The method for providing liquid ink to an ink jet print head according to claim 25, wherein step e is performed if step d determines that the amount of ink in the reservoir is not above the predetermined level.

27. The method for providing liquid ink to an ink jet print head according to claim 26, wherein the predetermined level is defined as approximately 8.25 grams.

28. The method for providing liquid ink to an ink jet print head according to claim 27, further including the step of positioning the print head to receive ink in the reservoir if step b determines that the print head is not positioned to receive ink in the reservoir.

29. The method for providing liquid ink to an ink jet print head according to claim 28, further including the step of delaying the execution of any command that is not compatible with adding ink to the reservoir.

30. The method for providing liquid ink to an ink jet print head according to claim 29, wherein the imaging apparatus further includes a sensor for detecting an amount of ink in the reservoir.

31. The method for providing liquid ink to an ink jet print head according to claim 30, wherein the sensor comprises a conductivity probe that forms a portion of an electrical circuit, the electrical circuit providing a high voltage signal corresponding to a probe open condition when the amount of ink is at or below the predetermined level.

32. A method for providing liquid ink to ink ejecting orifices in an ink jet print head in an imaging apparatus, the imaging apparatus including at least one reservoir for supplying the liquid ink to the print head orifices, the method comprising the steps of:

a. maintaining a first estimate in a memory source of a first amount of liquid ink in the reservoir;

b. calculating a second estimate of a second amount of liquid ink remaining in the reservoir after the imaging apparatus executes a first ink consumption operation;

c. updating the first estimate in the memory source to a third estimate that equals the second estimate;

d. comparing the third estimate to a plurality of ranges of amounts to determine which of the ranges encompasses the third estimate; and e. adding ink to the reservoir if the encompassing range indicates that the reservoir may receive additional ink or the reservoir requires ink to be added before the imaging apparatus executes a second ink consumption operation.

33. The method for providing liquid ink to an ink jet print head according to claim 32, wherein step b comprises calculating a fourth estimate of a fourth amount of liquid ink that is required to execute the first ink consumption operation and subtracting the fourth estimate from the first estimate to reach the second estimate.

34. The method for providing liquid ink to an ink jet print head according to claim 33, wherein the first and second ink consumption operations comprise a printing operation or a purging operation.

35. The method for providing liquid ink to an ink jet print head according to claim 34, wherein the first ink consumption operation comprises a printing operation and the fourth estimate is calculated by counting a number of ink pixels used in the printing operation to determine the fourth amount of ink used to execute the printing operation.

36. The method for providing liquid ink to an ink jet print head according to claim 35, wherein the memory source comprises nonvolatile RAM.

37. The method for providing liquid ink to an ink jet print head according to claim 36, wherein the imaging apparatus further includes a sensor for detecting an amount of ink in the reservoir, and step e is performed if the sensor detects approximately 8.25 grams or less of ink.

38. The method for providing liquid ink to an ink jet print head according to claim 37, wherein step e is performed if the sensor detects approximately 10.75 grams or more of ink in the reservoir and the third estimate is less than approximately 11.50 grams of ink.

* * * * *